US008136378B2

(12) United States Patent
Golovashchenko et al.

(10) Patent No.: US 8,136,378 B2
(45) Date of Patent: Mar. 20, 2012

(54) SEAL FOR FLUID FORMING TOOLS

(75) Inventors: Sergey Fedorovich Golovashchenko, Beverly Hills, MI (US); John Joseph Francis Bonnen, Milford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 362 days.

(21) Appl. No.: 12/563,487

(22) Filed: Sep. 21, 2009

(65) Prior Publication Data

US 2011/0067468 A1 Mar. 24, 2011

(51) Int. Cl.
*B21D 39/08* (2006.01)

(52) U.S. Cl. ..... 72/60; 72/61; 72/62

(58) Field of Classification Search ..... 72/54–63
See application file for complete search history.

(56) References Cited

U.S. PATENT DOCUMENTS

| | | | | |
|---|---|---|---|---|
| 4,791,796 | A * | 12/1988 | Ford | 72/62 |
| 4,805,430 | A * | 2/1989 | Schmitz et al. | 72/58 |
| 5,525,047 | A | 6/1996 | Sternenberg et al. | |
| 6,532,785 | B1 * | 3/2003 | Gmurowski | 72/61 |
| 6,804,979 | B2 | 10/2004 | Gomez | |
| 2001/0025489 | A1 | 10/2001 | Bockling et al. | |

FOREIGN PATENT DOCUMENTS

| | | |
|---|---|---|
| EP | 0218185 | 1/1992 |
| EP | 1510737 | 3/2005 |
| JP | 8325734 | 12/1995 |
| JP | 8303590 | 11/1996 |
| WO | 01/42690 A1 | 6/2001 |

* cited by examiner

*Primary Examiner* — David Jones
(74) *Attorney, Agent, or Firm* — Raymond L. Coppiellie; Brooks Kushman P.C.

(57) ABSTRACT

An electro-hydraulic forming tool for forming a sheet metal blank in a one-sided die has first and second rigid rings that engage opposite sides of a sheet metal blank. The rigid rings are contained within slots on a die portion and a hydraulic force applicator portion of the forming tool. The seals are either resiliently biased by an elastomeric member or inherently resiliently biased into contact with the blank.

19 Claims, 4 Drawing Sheets

SEAL FOR FLUID FORMING TOOLS

STATEMENT REGARDING FEDERALLY SPONSORED RESEARCH OR DEVELOPMENT

This invention was made with U.S. Government support under Contract No. DE-FG36-08GO18128 awarded by the Department of Energy. The Government has certain rights in this invention.

BACKGROUND

1. Technical Field

The present invention relates to seals for tools that use fluid to form a part against a rigid forming surface.

2. Background Art

Fluid forming processes generally include processes in which a workpiece is formed in a tool where one side of the tool is provided by a liquid. The other side of the tool is generally a rigid die against which the part is formed. Examples of fluid forming processes include hydro-forming, bladder press forming, super-plastic forming, electro-hydraulic forming, and explosive forming.

Traditional seals for such applications include elastomeric seals, such as O-rings. Elastomeric seals used in hydro-forming applications may feature an O-ring inserted in a circumferential groove that is pushed inside the tube that is to be hydro-formed. Such O-ring seals have a short useful life in hydro-forming applications. In sheet forming applications, sealing requirements are more stringent. Elastomeric seals resist drawing the flange of the sheet across the seal.

Metal-to-metal seals are used in hydro-forming applications that include a mandrel that includes a conical surface that is inserted into the tube that is to be hydro-formed. The mandrel is axially moved to provide additional material for the forming process. This approach is not adaptable to sheet forming processes to permit the outer edge of the flange of the sheet metal blank to be drawn into the forming die.

In hydro-mechanical drawing operations, metal-to-metal surface contact has been proposed in which ribs formed on the die directly contact the metal blank. This approach suffers from considerable leakage of fluid from the die cavity. With this approach, the pressure level used in the forming process must be limited. A disadvantage of this approach is excessive wear of the ribs formed on the die.

In super-plastic forming operations, seals are used in which metal-to-metal contact is obtained by indenting seating elements or ribs into the body of the blank. With this approach, only minimal movement of the blank across the sealing line is permitted.

In electro-hydraulic forming processes, elastomeric sealing elements, such as O-ring seals, are utilized. In electro-hydraulic forming, elastomeric seals have lives that are limited to forming several dozen parts and, in any event, are certainly not expected to exceed several hundred parts. As a result, electro-hydraulic forming is limited to low volume applications. The sealing requirements for electro-hydraulic forming are more stringent than for hydro-forming because the sealing system must be able to preserve the vacuum between the blank and the die, and another seal must be provided on the side of the blank facing the fluid filled chamber to contain the fluid.

The above problems relating to sealing in fluid forming applications are addressed by Applicants' development as summarized below.

SUMMARY

Some fluid forming technologies, such as electro-hydraulic forming, have been limited to low volume production due, in part, to a need for the development of an effective sealing system. Applicants have discovered a long-standing problem relating to the use of elastomeric O-ring seals in laboratory testing of electro-hydraulic forming tools. If metal is permitted to move or flow across the elastomeric O-ring sealing surfaces, the sealing surfaces become severely deformed after several cycles. This problem severely limits or precludes the use of electro-hydraulic forming for high volume production applications.

According to one aspect of the disclosure, a metal sealing element is placed in contact with the blank that is to be formed. In one embodiment, the metal sealing element is backed by an elastomeric element that spring biases the metal sealing element into engagement with one or both sides of the blank. In other embodiments, the metal sealing element is constructed to use the inherent resilience of the metal to provide an integral spring biasing action against one or both sides of the blank.

These and other aspects of Applicants' concept will be better understood in view of the attached drawings and the following detailed description of the disclosed embodiments.

DETAILED DESCRIPTION

Figure 1:
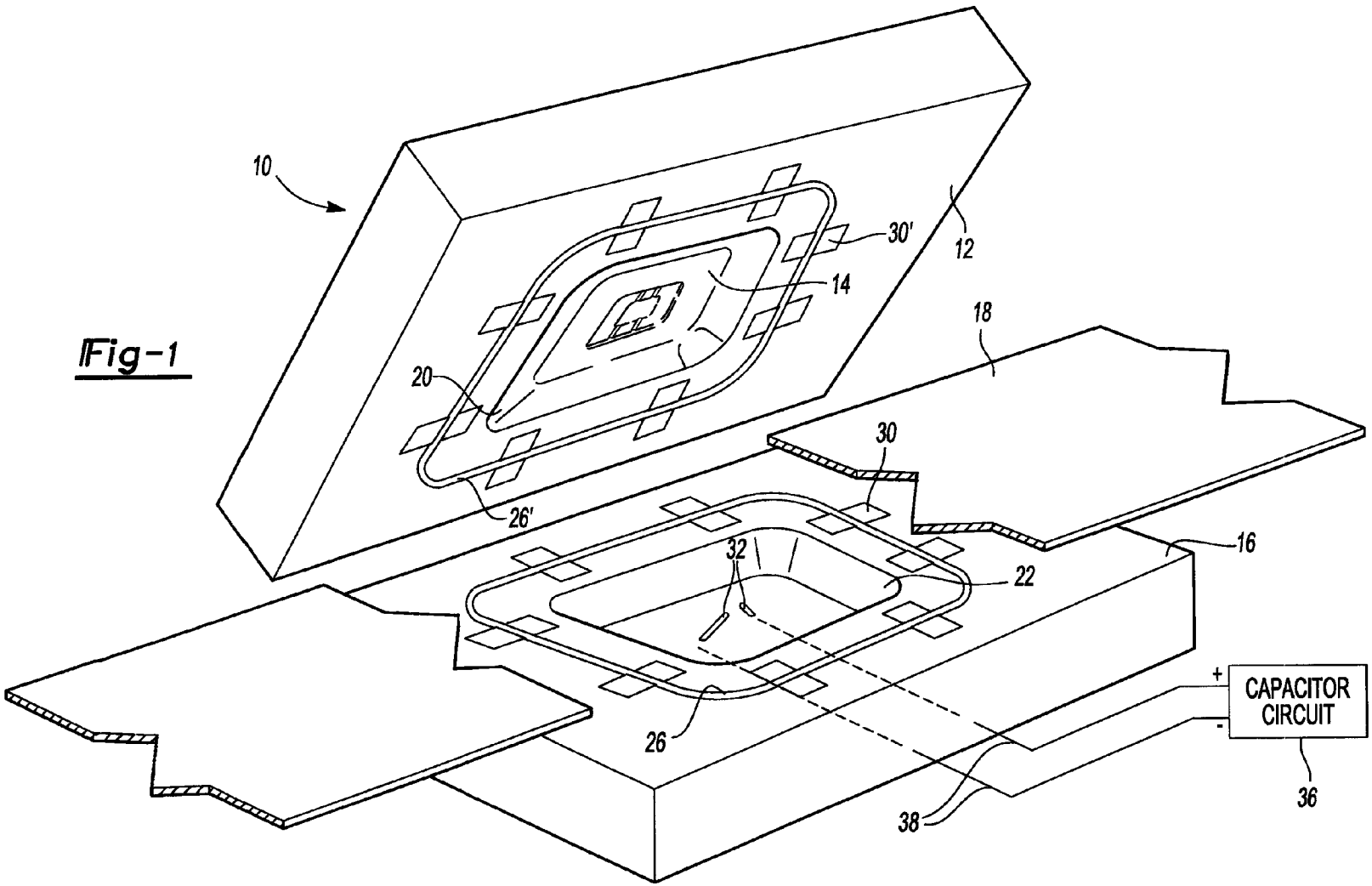
FIG. 1 is a diagrammatic perspective view parts of an electro-hydraulic forming tool.
Figure 2:
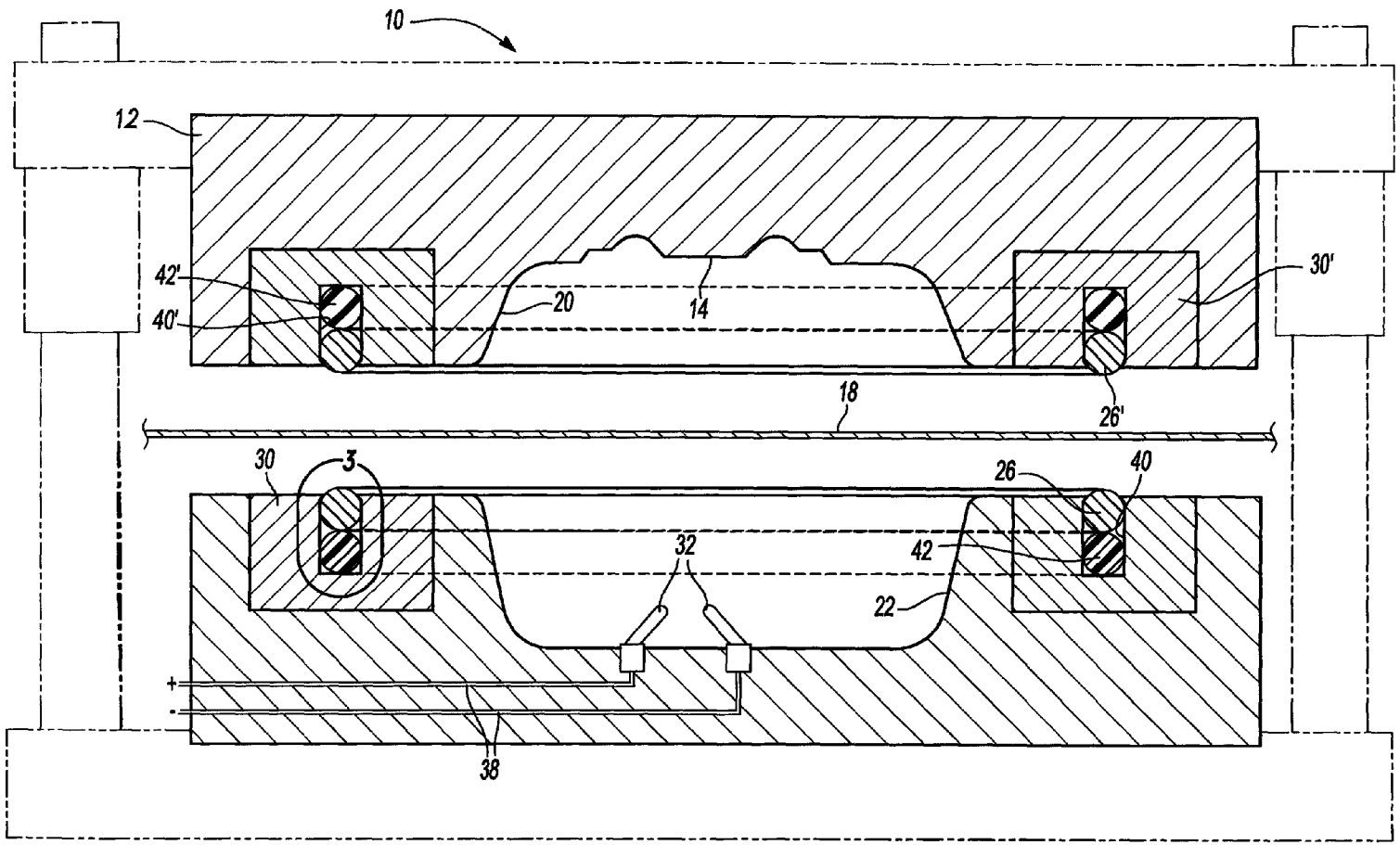
FIG. 2 is a diagrammatic cross-sectional view of the electro-hydraulic forming machine shown in phantom lines with the forming tool in its open position with a blank disposed between the die and the force applicator.

Referring to FIGS. 1 and 2, an electro-hydraulic forming ("EHF") tool is generally designated by reference numeral 10. The EHF tool 10 includes a die 12 that includes a forming surface 14. An electro-hydraulic force applicator 16 is shown disposed below the die 12. It should be understood that the EHF tool 10 would also include a mechanism for clamping the die 12 and electro-hydraulic force applicator 16 together. A blank 18 comprising a sheet metal blank of steel, aluminum, or another metal. The EHF tool 10 of the present invention is particularly well suited for performing operations on high-strength steel or high-strength aluminum alloys.

The die 12 includes a die cavity 20 which is evacuated prior to a forming operation. The electro-hydraulic force applicator 16 includes a liquid chamber 22. When the EHF tool 10 is closed, the die cavity 20 is aligned with the liquid chamber 22. The liquid chamber 22 is filled with a liquid, such as oil or water, when the EHF tool is closed.

A first metal seal 26 is provided on the electro-hydraulic force applicator 16 and extends around the periphery of the liquid chamber 22. A second metal seal 26' is provided in the die 12 and extends around the periphery of the die cavity 20. The first and second metal seal elements are held in place by inserts 30 and 30', as will be more specifically described with reference to FIGS. 2-4 below.

A pair of electrodes 32 are provided in the liquid chamber 22 that are connected to a capacitor circuit 36, or charge storage device, by leads 38.

In operation, the blank 18 is inserted between the die 12 and the electro-hydraulic force applicator 16. The EHF tool 10 is closed forcing the first metal seal element 26 into engagement with the lower side of the blank 18, as shown in FIG. 1, while the second metal seal element 26' is brought into sealing engagement with the upper side of the blank 18. The die cavity 20 is evacuated by drawing a vacuum through ports (not shown) in the die 12. The liquid chamber 22 is filled or refilled with liquid that is provided to the liquid chamber 22 in the electro-hydraulic force applicator 16 through fluid fill/evacuation ports (not shown). The liquid chamber 22 is preferably completely filled with liquid. The capacitor circuit 36 is selectively discharged through the electrodes 32 to create an arc that generates a shockwave that drives the blank 18 into engagement with the forming surface 14 of the die 12. The first metal seal element 26 seals the fluid with the liquid chamber 22. The second metal seal element 26' provides a seal to maintain the vacuum within the die cavity 20.

Referring to FIG. 2, the die 12 is shown in the EHF tool 10 above the electro-hydraulic force applicator 16 on the opposite side of the sheet metal blank 18. The die cavity 20 is aligned with the liquid chamber 22. A slot 40 is provided in the electro-hydraulic force applicator 16 that receives the first metal seal element 26. A slot 40' is provided in the die 12 that receives the second metal seal element 26'. In each slot, a resilient backing ring 42' is provided that biases the respective first and second seal elements 26 and 26' toward the blank 18. The cross section of FIG. 2 is taken through the inserts 30 and 30' that will be more particularly described with reference to FIGS. 3 and 4 below.

Figure 4:
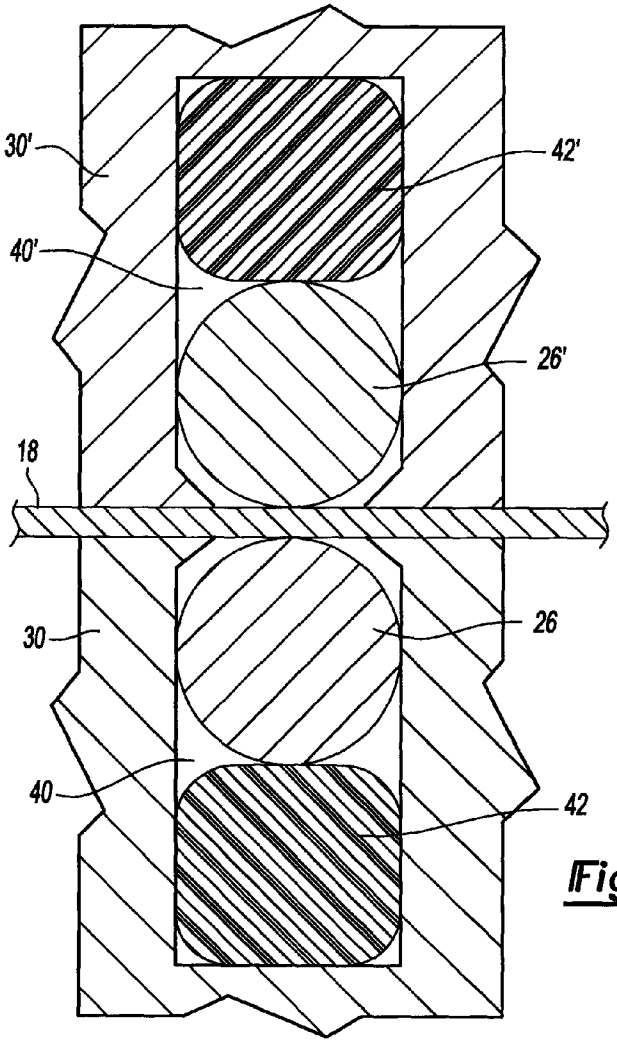
FIG. 4 is a diagrammatic fragmentary cross-sectional view of the insert and the metal seal shown in FIG. 3 in sealing engagement with the blank.
Figure 3:
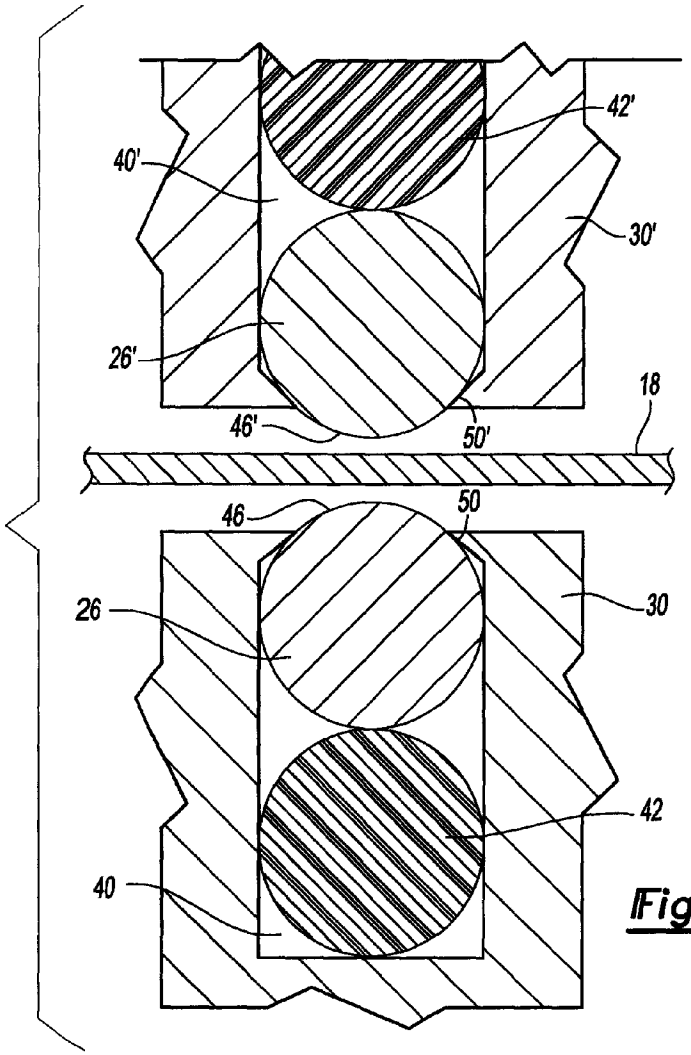
FIG. 3 is a diagrammatic fragmentary cross-sectional view showing an insert and a metal seal backed by an elastomeric seal prior to engaging the blank.

Referring to FIGS. 3 and 4, the structure of the inserts 30 and 30' and seals 26 and 26' will be described in greater detail. FIG. 3 shows a pair of inserts 30, 30' on opposite sides of the blank 18 prior to engagement with the blank 18. Seal element 26 is below the blank 18, while seal element 26' is disposed above the blank 18. The seal elements are each backed up by the resilient backing ring 42. The first seal element 26 and backing ring 42 are disposed in a slot 40 within the insert 30. Second seal element 26' and backing ring 42' are disposed in a slot 40'. A protruding portion 46 of the first seal element 26 protrudes from the slot 40. The first seal element 26 is retained by retaining lips 50 formed on the insert 30. No retaining lips are provided in the portions of the slot 40 that are between the inserts 30. A protruding portion 46' of the second seal element 26' protrudes from the insert 30'. Retaining lips 50' provided by the insert 30' retain the second seal element 26' within the slot 40'. No retaining lips are provided in the portions of the slot 40' that are between the inserts 30'.

The elastomeric rings 42 and 42' as illustrated have a circular cross-section, however, they could have a rectangular or other cross-section if desired.

Referring to FIG. 4, the inserts 30, 30' shown in FIG. 3 are shown with the first and second seal elements engaging the blank 18. The first and second seal elements 26 and 26' are pushed into their respective slots 40 and 40' and no longer protrude from the slots. The resilient backing rings 42, 42' are compressed by the first and second seal elements 26 and 26'.

The seal 26 for the chamber shown in FIG. 2 that prevents liquid from flowing out of the chamber 22 is established by the contact of the seal element 26 with the blank 18. A seal is also created between seal element 26 and the resilient backing ring 42 that prevents liquid from passing through the slot 40. The second seal element 26' also establishes a seal with the blank 18 and the resilient backing ring 42' forms a seal within the slot 40' that prevents loss of vacuum in the die cavity 20.

The blank 18 may be drawn into the die cavity 20 when the electro-hydraulic force applicator 16 is discharged to form a portion of the blank 18 into the die cavity 20. An effective seal is provided by the first and second seal elements and their biasing backing rings 42, 42' while the metal seal elements 26 and 26' are not damaged by the blank 18 being drawn into the die cavity 20. The resilient backing rings 42, 42' are not destroyed by the movement of the blank 18 because they do not contact the blank 18.

Figure 5:
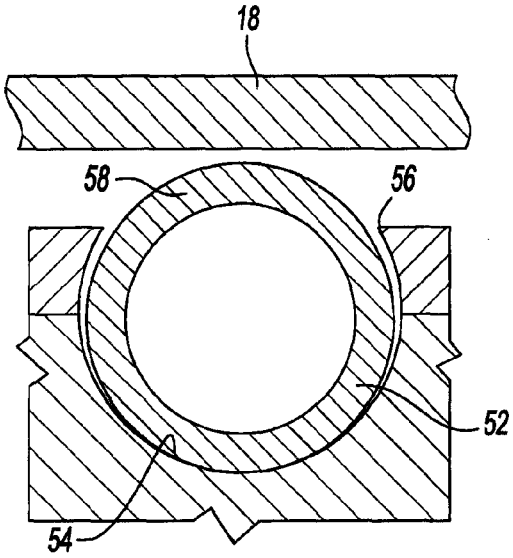
FIG. 5 is a diagrammatic fragmentary cross-sectional view of a hollow tubular seal that may be used with the electro-hydraulic forming tool shown in FIG. 1 prior to engaging the blank.
Figure 6:
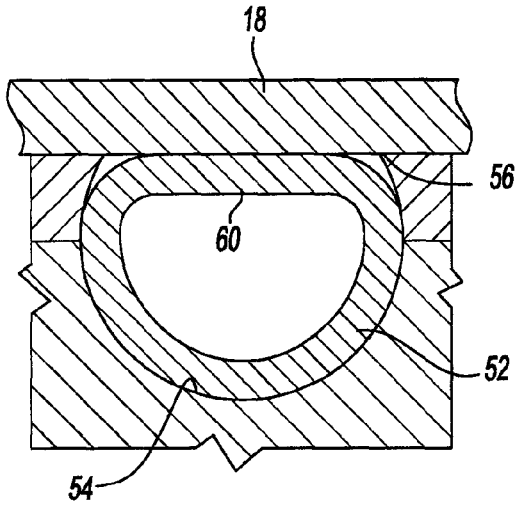
FIG. 6 is a fragmentary cross-sectional view of the hollow tubular seal shown in FIG. 5 shown in sealing engagement with the blank.

Referring to FIGS. 5 and 6, an alternative embodiment is shown to include a hollow tubular seal 52. The hollow tubular seal 52 is preferably formed of metal. It should be understood that a hollow tubular seal would be provided on both sides of the blank 18 similar to that shown in FIGS. 3 and 4. The hollow tubular seal 52 is disposed in a slot 54 and held in place by means of retainers 56. A protruding portion 58 of the hollow tubular seal 52 is shown protruding from the slot 54 prior to engaging the blank 18.

Referring to FIG. 6, the hollow tubular seal 52 is shown within the slot 54. The protruding portion 58 is compressed upon engagement with the blank 18 and a compressed wall portion 60 is shown as a flattened side on the hollow tubular seal 52. The hollow tubular seal 52 is preferably formed of steel or other metal that is resilient and has high fatigue resistance. The blank 18 may be drawn into the die cavity 20 during the forming process and the hollow tubular seal 52 is not believed to be substantially adversely affected by the drawing movement of the blank 18 across the compressed wall portion 60.

Figure 7:
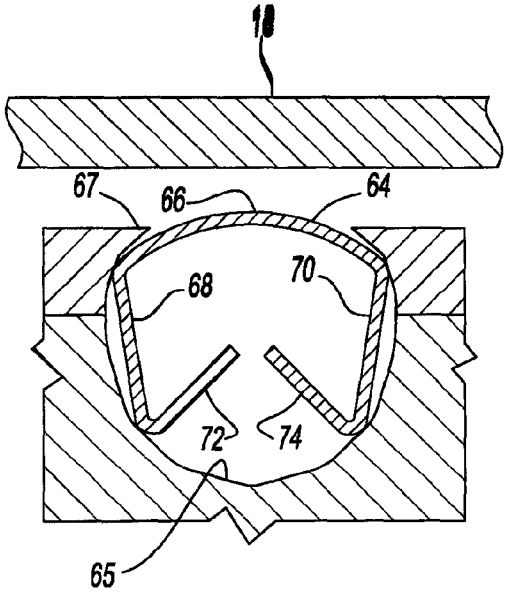
FIG. 7 is a diagrammatic fragmentary cross-sectional view of an integral open cross-section seal that may be used with the electro-hydraulic forming tool shown in FIG. 1 prior to engaging the blank.
Figure 8:
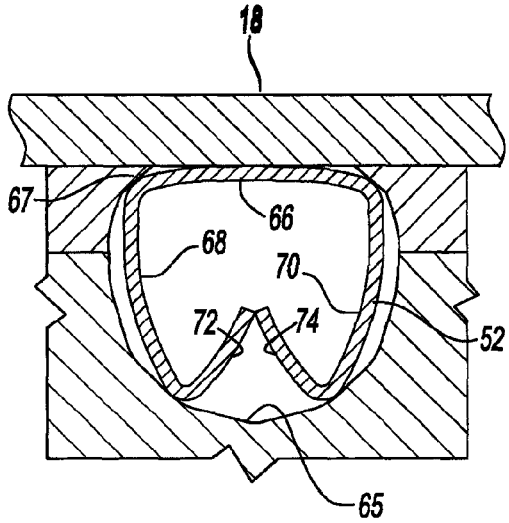
FIG. 8 is a diagrammatic fragmentary cross-sectional view of the seal shown in FIG. 7 shown in sealing engagement with the blank.

Referring to FIGS. 7 and 8, another alternative embodiment is illustrated in which an integral open cross-section seal 64 is provided in a slot 65. The open seal 64 includes a protruding portion 66 that extends from the slot 65. Retaining lips 67 are provided to retain the seal 64 in the slot 65. A first and second leg 68 and 70 extend into the slot 65 and away from the protruding portion 66. First and second flanges 72 and 74 are provided on the opposite ends of the first and second legs 68 and 70, respectively, from the protruding portion 66. As shown in FIG. 7, the protruding portion 66 extends from the slot 65 toward the blank 18 prior to contacting the blank 18.

Referring to FIG. 8, the integral open cross-section seal 64 is shown after engaging the blank 18 to form a seal between the protruding portion 66 and the blank 18. The open seal 64 is also sealed within slot 65 by the contact of the first and second leg 68 and 70 with the sides of the slot 65. The blank 18 is permitted to be drawn towards the die cavity 20 across the protruding portion 66 that is pushed into the slot 65 by the blank 18.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. A tool for forming a blank comprising:
a die defining a die cavity;
a forming tool defining a chamber and having a surface that defines a slot extending about the chamber;
a metal ring disposed in the slot;
a plurality of inserts provided in the forming tool that retain the ring in the slot;
means for biasing the ring toward the blank; and
wherein the die cavity and the chamber are held together on opposite sides of the blank to seal between the metal ring and the blank.

2. The tool of claim 1 wherein the inserts are flush with the surface and have a retaining lip that restricts the opening of the slot.

3. The tool of claim 1 wherein a peripheral portion of the blank is drawn across the ring as the blank is formed into the die cavity.

4. The tool of claim 1 wherein the means for biasing the ring is provided by the structure of the ring.

5. A tool for forming a blank comprising:
a die defining a die cavity;
a forming tool defining a chamber and having a surface that defines a slot extending about the chamber, wherein the forming tool is an electro-hydraulic forming tool that contains a liquid in the chamber and wherein at least one electrode is submerged in the liquid and connected to a stored electrical charge circuit;
a metal ring disposed in the slot;
means for biasing the ring toward the blank; and
wherein the die cavity and the chamber are held together on opposite sides of the blank to seal between the metal ring and the blank.

6. The tool of claim 5 wherein a peripheral portion of the blank is drawn across the ring as the blank is formed into the die cavity.

7. A tool for forming a blank comprising:
a die defining a die cavity;
a forming tool defining a chamber and having a surface that defines a slot extending about the chamber;
a metal ring disposed in the slot;
an elastomeric member disposed in the slot on the opposite side of the metal ring from the blank that biases the ring toward the blank; and
wherein the die cavity and the chamber are held together on opposite sides of the blank to seal between the metal ring and the blank.

8. The tool of claim 7 wherein the elastomeric member is a ring having a circular cross-section.

9. A tool for forming a blank comprising:
a die defining a die cavity;
a forming tool defining a chamber and having a surface that defines a slot extending about the chamber;
a compressible hollow tubular metal ring disposed in the slot that biases the ring toward the blank; and
wherein the die cavity and the chamber are held together on opposite sides of the blank to seal between the metal ring and the blank.

10. The tool of claim 9 wherein the ring is formed with a top wall that is supported by a pair of side walls that exert a spring force on the top wall.

11. The tool of claim 10 wherein each of the side walls have a lower flange that extends toward the lower flange of the other side wall and that engages the a base area of the slot.

12. A tool for forming a blank comprising:
a die defining a single sided die cavity;
an electro-hydraulic forming tool defining a chamber that is positioned to face the die cavity, the chamber being filled with a liquid, at least one electrode submerged in the liquid, the electrode being connected to an electrical discharge circuit, and wherein the tool has a surface that defines a slot extending about the chamber;
a rigid ring at least partially disposed in the slot that engages the blank when the blank is loaded into the tool, and wherein the ring is resiliently supported on the tool; and
wherein the die cavity and the chamber are held together on opposite sides of the blank to seal between the metal ring and the blank before the circuit is discharged through the electrode to form the blank into the die cavity.

13. The tool of claim 12 further comprising a plurality of inserts provided in the forming tool that retain the ring in the slot.

14. The tool of claim 13 wherein the inserts are flush with the surface and restrict the opening of the slot.

15. The tool of claim 12 wherein a peripheral portion of the blank is drawn across the ring as the blank is formed into the die cavity.

16. The tool of claim 12 wherein the means for biasing the ring is an elastomeric member disposed in the slot on the opposite side of the metal ring from the blank.

17. The tool of claim 12 wherein the ring is formed as a hollow tubular member that is compressible to resiliently support the ring on the tool.

18. The tool of claim 12 wherein the ring is formed with a top wall that is supported by a pair of side walls that exert a spring force on the top wall.

19. An electro-hydraulic forming tool for forming a blank comprising:
a die defining a single sided die cavity and a first slot extending about the cavity, and wherein the die cavity is evacuated;
a first rigid ring at least partially disposed in the first slot that engages the blank when the blank is loaded into the tool, and wherein the first rigid ring is resiliently supported relative to the first slot;
an electro-hydraulic discharge system defining a chamber that is positioned to face the die cavity, the chamber being filled with a liquid, a pair of electrodes submerged in the liquid, the electrodes being connected to an electrical charge storage circuit, and wherein a surface is provided that defines a second slot extending about the chamber;
a second rigid ring at least partially disposed in the second slot that engages the blank when the blank is loaded into the tool, and wherein the second ring is resiliently supported relative to the second slot; and
a press mechanism that holds the die cavity and the chamber together on opposite sides of the blank to seal between the first metal ring and the blank to maintain a vacuum in the die cavity and to seal between the second metal ring and the blank to contain the liquid in the chamber before the electrical charge storage circuit is discharged through the electrodes to form the blank into the die cavity.

* * * * *